US008387573B2

(12) United States Patent
Lee et al.

(10) Patent No.: US 8,387,573 B2
(45) Date of Patent: Mar. 5, 2013

(54) VARIABLE COMPRESSION RATIO DEVICE

(75) Inventors: Eun Ho Lee, Hwaseong (KR); Jin-Kook Kong, Suwon (KR); Soo-Hyung Woo, Yongin (KR)

(73) Assignee: Hyundai Motor Company, Seoul (KR)

( * ) Notice: Subject to any disclaimer, the term of this patent is extended or adjusted under 35 U.S.C. 154(b) by 412 days.

(21) Appl. No.: 12/868,423

(22) Filed: Aug. 25, 2010

(65) Prior Publication Data

US 2011/0126806 A1 Jun. 2, 2011

(30) Foreign Application Priority Data

Dec. 2, 2009 (KR) ..... 10-2009-0118735

(51) Int. Cl.
*F02B 75/04* (2006.01)

(52) U.S. Cl. ..... 123/48 B; 123/78 BA

(58) Field of Classification Search ..... 123/48 R, 123/48 B, 78 R, 78 B, 78 BA
See application file for complete search history.

(56) References Cited

U.S. PATENT DOCUMENTS 2,151,853 A * 3/1939 Jonville et al. ..... 123/78 BA

* cited by examiner

*Primary Examiner* — Noah Kamen
(74) *Attorney, Agent, or Firm* — Morgan, Lewis & Bockius LLP

(57) ABSTRACT

A variable compression ratio device that includes a piston, a piston pin, and a connecting rod of which one end is connected to the piston by the piston pin, may include an eccentric ring rotatably coupled in a ring at the one end of the connecting rod, wherein the inner circumference thereof rotatably contacts with the outer circumference of the piston pin, an operating pin that longitudinally reciprocates in the piston pin, variable sliders that selectively contact one of both ends of the operating pin under a cylinder to push the one of both ends to the opposite side, and a guide plate that slidably supports the variable sliders, wherein, one end of a variable shaft selectively rotating is connected to the variable slider and a sliding direction of the variable slider is controlled by the rotation of the variable shaft.

13 Claims, 15 Drawing Sheets

VARIABLE COMPRESSION RATIO DEVICE

CROSS-REFERENCE TO RELATED APPLICATION

The present application claims priority to Korean Patent Application No. 10-2009-0118735 filed in the Korean Intellectual Property Office on Dec. 2, 2009, the entire contents of which is incorporated herein for all purposes by this reference.

BACKGROUND OF THE INVENTION

1. Field of the Invention

The present invention relates to a variable compression ratio device. More particularly, the present invention relates to variable compression ratio device that varies the compression ratio of gas mixture in a combustion chamber in accordance with the driving conditions.

2. Description of Related Art

In general, thermal efficiency of a heat engine increases with the increase of a compression ratio, while thermal efficiency of a spark ignition engine increases when ignition timing is advanced to a predetermined level. However, the spark ignition engine makes abnormal combustion when the ignition timing is advanced at a high compression ratio and the engine may be damaged, such that the advanced angle of ignition timing is limited and the output may be reduced.

A variable compression ratio device is a device that varies the compression ratio of gas mixture, in accordance with operation conditions. With the variable compression ratio device, it is possible to improve fuel efficiency by increasing the compression ratio of gas mixture under a low-load condition of an engine, and prevent knocking and improve engine output by reducing the compression ratio of gas mixture under a high-load condition of the engine.

In order to achieve the variable compression ratio, there has been known a method of forming an oil chamber inside an eccentric ring disposed in a small end of a connecting rod and eccentrically rotating the eccentric ring by using hydraulic pressure generated by supplying oil into the oil chamber; however, in a variable compression ratio device according to the related art, it is required to increase pressure to maintain the position of the eccentric ring in the oil chamber when explosion pressure is applied, because the distance from the eccentric ring to the center of the oil chamber, such that the compression ratio is not maintained.

Further, it may be required to considerably increase oil pressure for varying the compression ratio.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention are directed to provide a variable compression ratio device having advantages of having an improved structure to vary the compression ratio inside a cylinder.

In an aspect of the present invention, the variable compression ratio device that includes a piston, a piston pin mounted to the piston, a crankshaft, and a connecting rod of which one end is connected to the piston by the piston pin and of which the other end is rotatably coupled to the crankshaft, may include an eccentric ring rotatably coupled in a ring at the one end of the connecting rod, wherein the inner circumference thereof rotatably contacts with the outer circumference of the piston pin and the center of the inner circumference thereof is biased from the center of the outer circumference thereof, an operating pin that longitudinally reciprocates in the piston pin, variable sliders that selectively contact one of both ends of the operating pin under a cylinder to push the one of both ends to the opposite side, and a guide plate that slidably supports the variable sliders such that the variable sliders vertically reciprocate with respect to the movement direction of the operating pin, wherein, one end of a variable shaft selectively rotating is connected to the variable slider and a sliding direction of the variable slider is controlled by the rotation of the variable shaft.

A mounting groove may be formed on the outer circumference of the eccentric ring and oil holes are formed at both lateral ends of the mounting groove in a circumferential direction.

A mounting protrusion may be couple to the mounting groove and forms oil chambers in the one end of the connecting rod in a forward and rearward direction of the mounting protrusion wherein the oil chambers are covered by a mounting cover to seal the mounting protrusion.

An oil supply channel may be formed in the connecting rod to supply oil to the oil holes, wherein an oil inlet hole is formed in the eccentric ring to receive oil from the oil supply channel of the oil connecting rod.

The piston pin may include an oil input hole to fluid-communicate with the oil inlet hole of the eccentric ring to receive the oil from the oil supply channel of the connecting rod and includes oil supply holes, wherein a control channel is formed in the operating pin and fluid-communicates with the oil inlet hole of the piston pin and selectively fluid-communicates with the one of the oil supply holes of the piston pin to supply the oil to one of the oil chambers in accordance with longitudinal movement of the operating pin, and wherein the operating pin further includes oil discharge channels formed in a longitudinal direction at both end portions thereof, and wherein the oil disposed in the other of the chambers are discharged through the oil supply hole not engaged with the control channel by fluid-connecting one of the oil discharge channel in the operating pin.

The ring of the connecting rod may include circulation grooves formed along the inner circumference of the ring and wherein the circulation grooves are connected to the oil holes of the eccentric ring.

A protrusion may be formed on the inner surface of the variable sliders to correspond to both ends of the operating pin, and disposed not to correspond to each other in the same moving direction.

The variable shaft and the variable sliders may be connected by operating arms, wherein shaft rings are formed on the outer circumference of the variable shaft to integrally rotate, the variable shaft and the operating arms are connected by first hinge portions formed at the shaft rings, the operating arms are connected with the variable sliders by second hinge portions, and as the variable shaft selectively rotates in one direction, the operating arms allow the variable sliders to reciprocate straight through the first hinge portions and the second hinge portions.

A guide rail may be formed on one side of the guide plate to guide the variable sliders to reciprocate forward and rearward and a fixing block is formed under the guide rail to fix the guide plate.

The variable shaft may be driven by a vacuum actuator individually provided.

According to a variable compression ratio device having the above configuration of the present invention, it is possible to reduce the number of parts and simplify the configuration, because it does not use oil pressure or an electric motor to rotate an eccentric ring.

Further, since the distance from the center of the eccentric ring to the oil chambers is large, it is possible to achieve large torque even from small force.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

Figure 1:
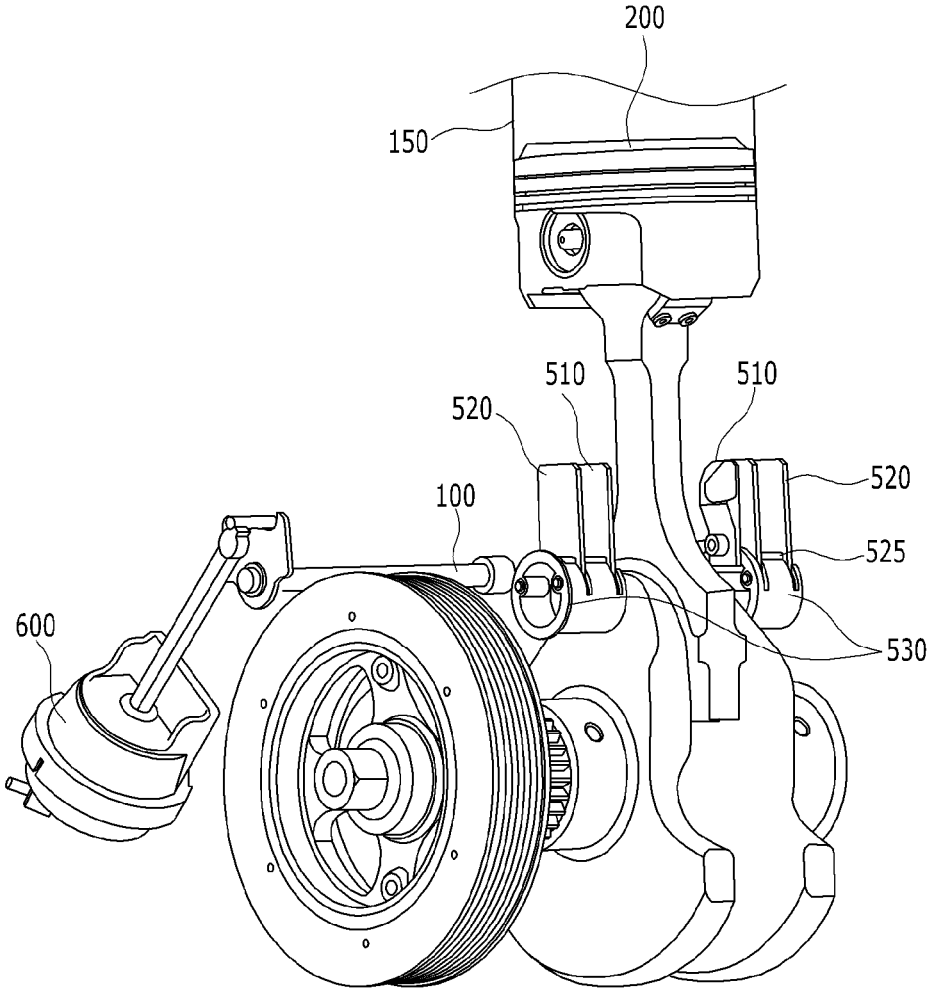
FIG. 1 is a perspective view of an exemplary variable compression ratio device according to the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

An exemplary embodiment of the present invention will hereinafter be described in detail with reference to the accompanying drawings.

FIG. 1 is a perspective view of a variable compression ratio device according to an exemplary embodiment of the present invention.

Figure 2:
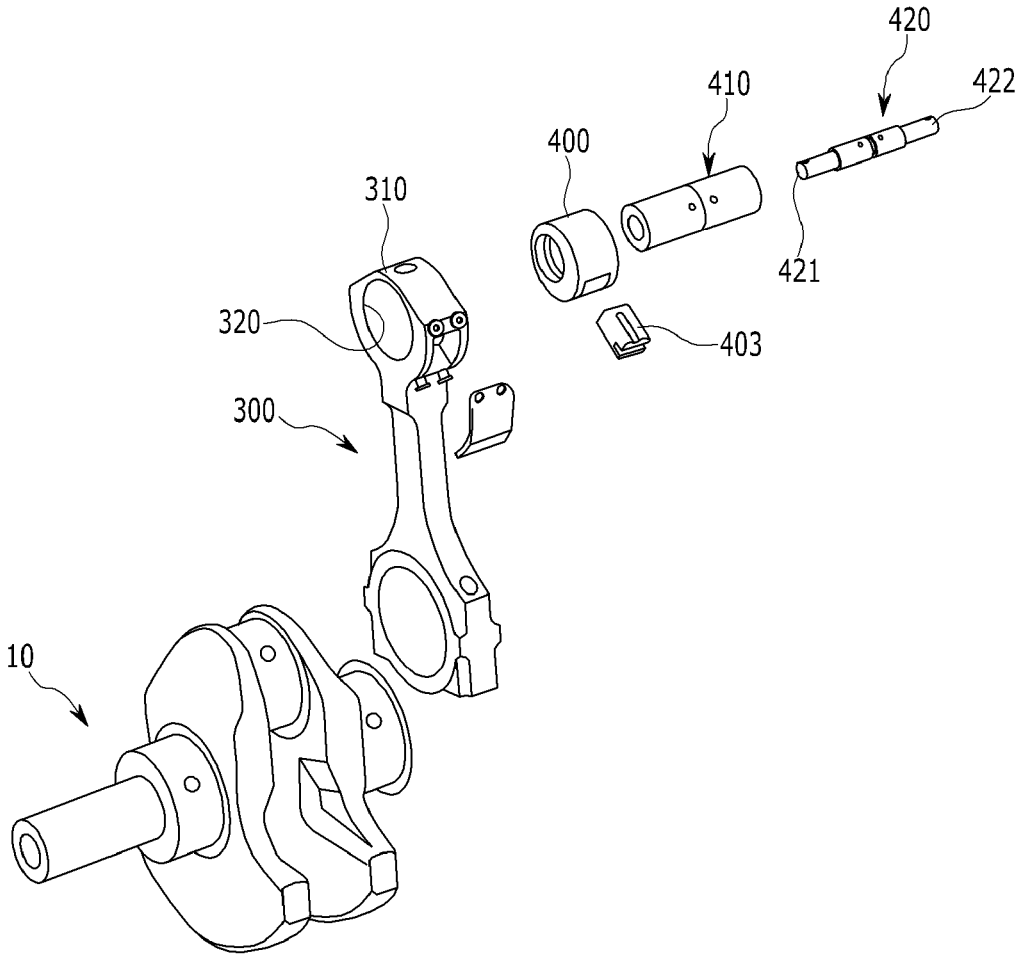
FIG. 2 is an exploded perspective view of an exemplary variable compression ratio device according to the present invention.

FIG. 2 is an exploded perspective view of a variable compression ratio device according to an exemplary embodiment of the present invention.

Figure 3:
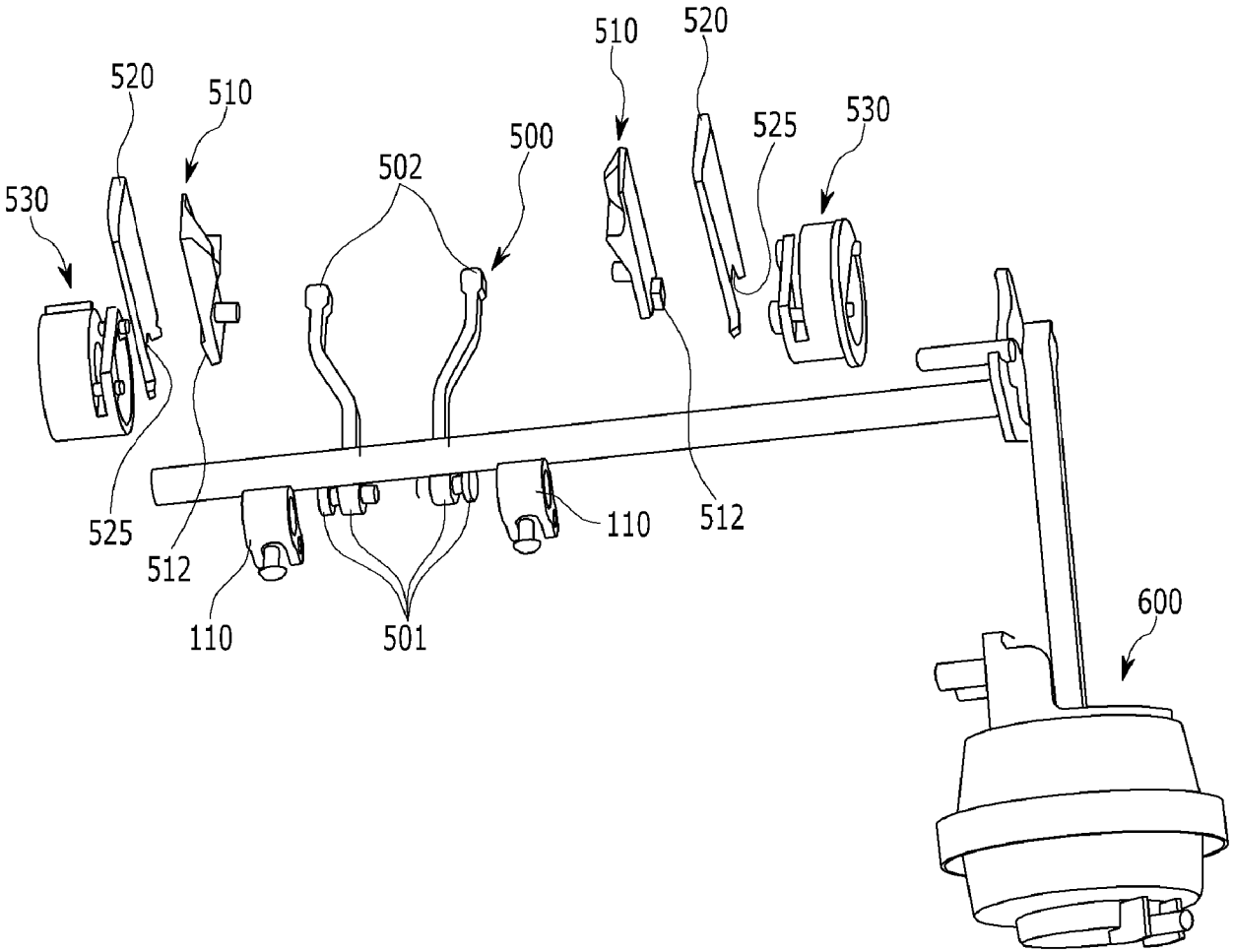
FIG. 3 is an exploded perspective view showing the driving part of an exemplary variable compression ratio device according to the present invention.

FIG. 3 is an exploded perspective view showing the driving part of a variable compression ratio device according to an exemplary embodiment of the present invention.

Figure 4:
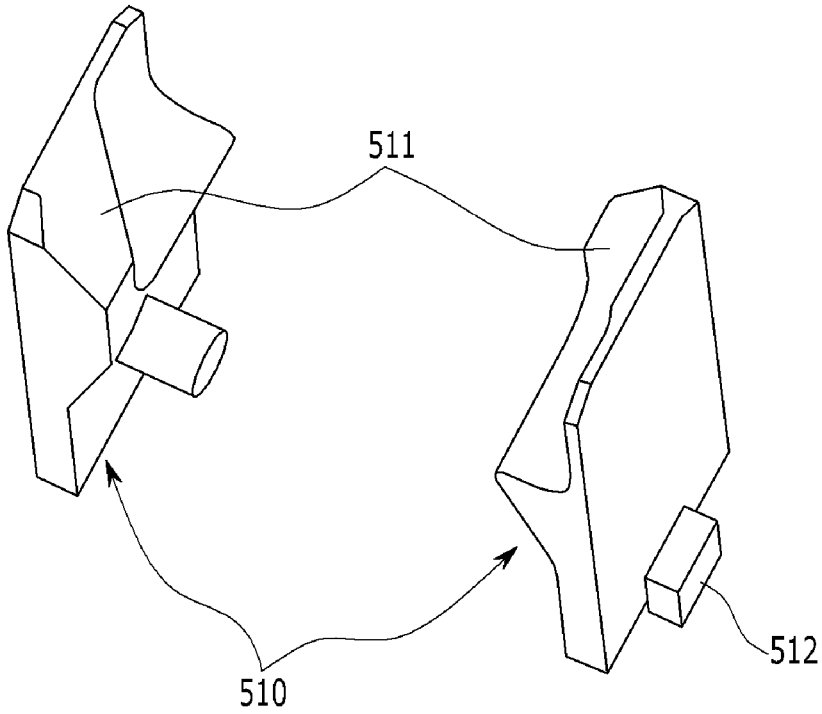
FIG. 4 is a perspective view showing a slider of an exemplary variable compression ratio device according to the present invention.

FIG. 4 is a perspective view showing a slider of a variable compression ratio device according to an exemplary embodiment of the present invention.

Figure 5:
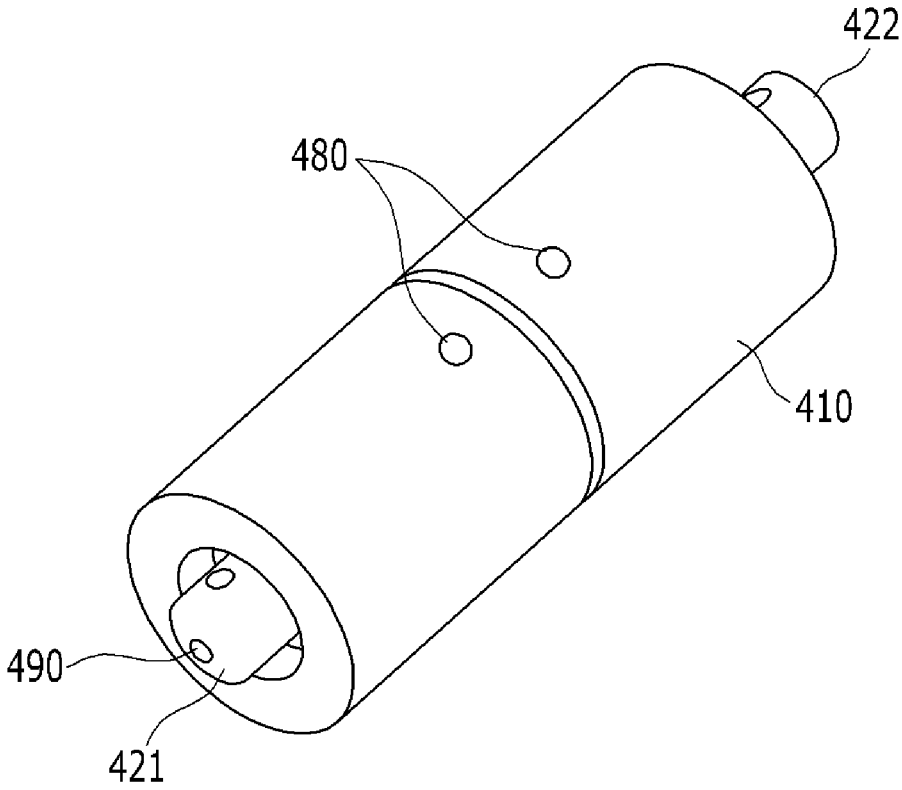
FIG. 5 is a perspective view showing a piston pin of an exemplary variable compression ratio device according to the present invention.

FIG. 5 is a perspective view showing a piston pin of a variable compression ratio device according to an exemplary embodiment of the present invention.

Figure 6:
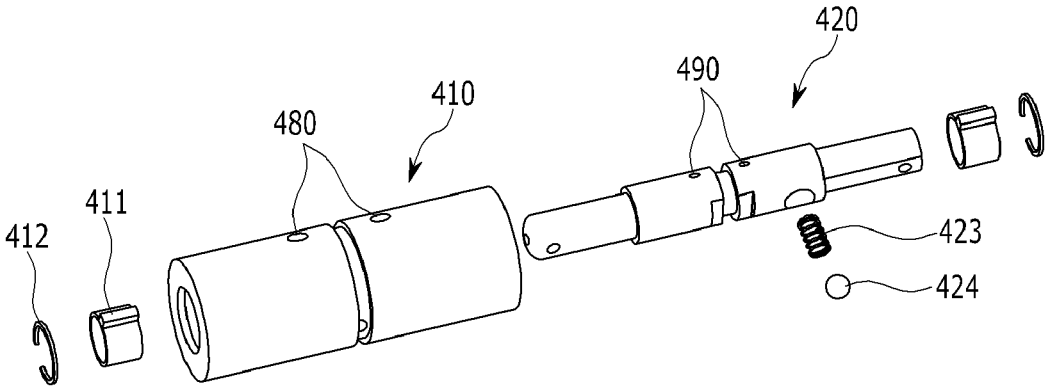
FIG. 6 is an exploded perspective view of FIG. 5.

FIG. 6 is an exploded perspective view of FIG. 5.

Figure 7:
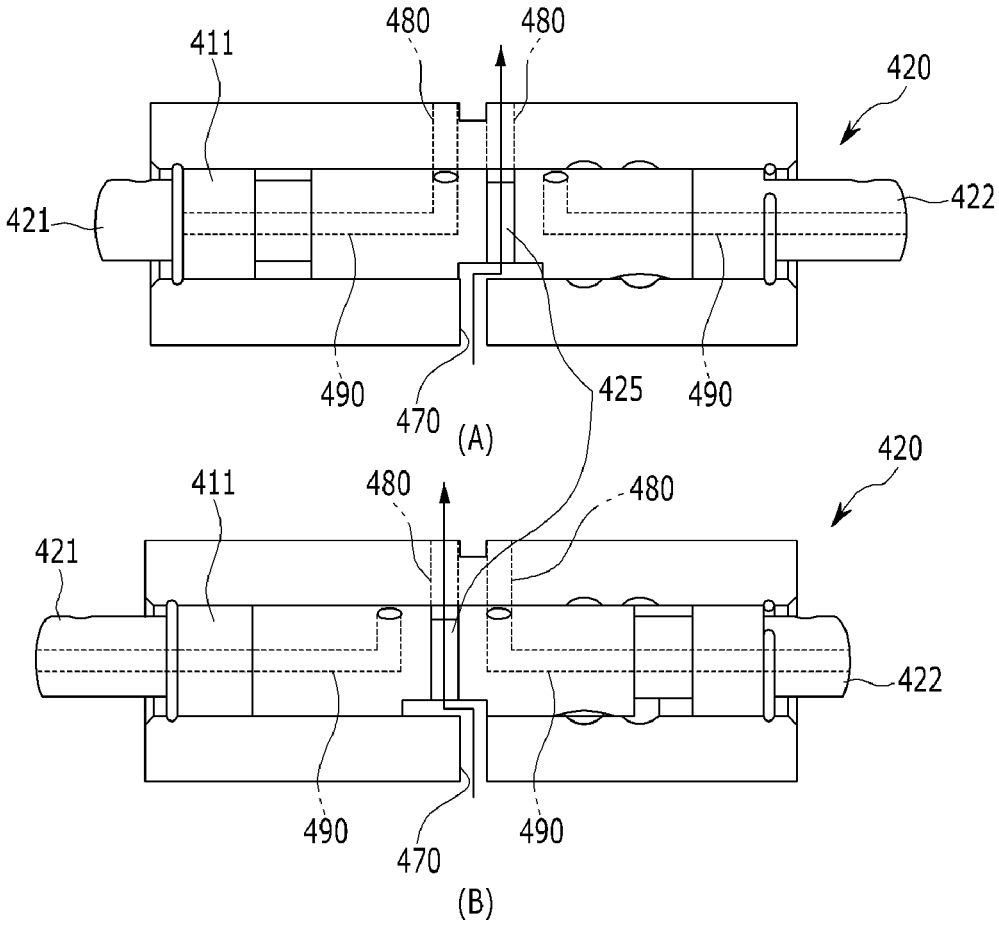
FIG. 7 is a view showing the operation of a piston pin of an exemplary variable compression ratio device according to the present invention.

FIG. 7 is a view showing the operation of a piston pin of a variable compression ratio device according to an exemplary embodiment of the present invention.

Figure 8:
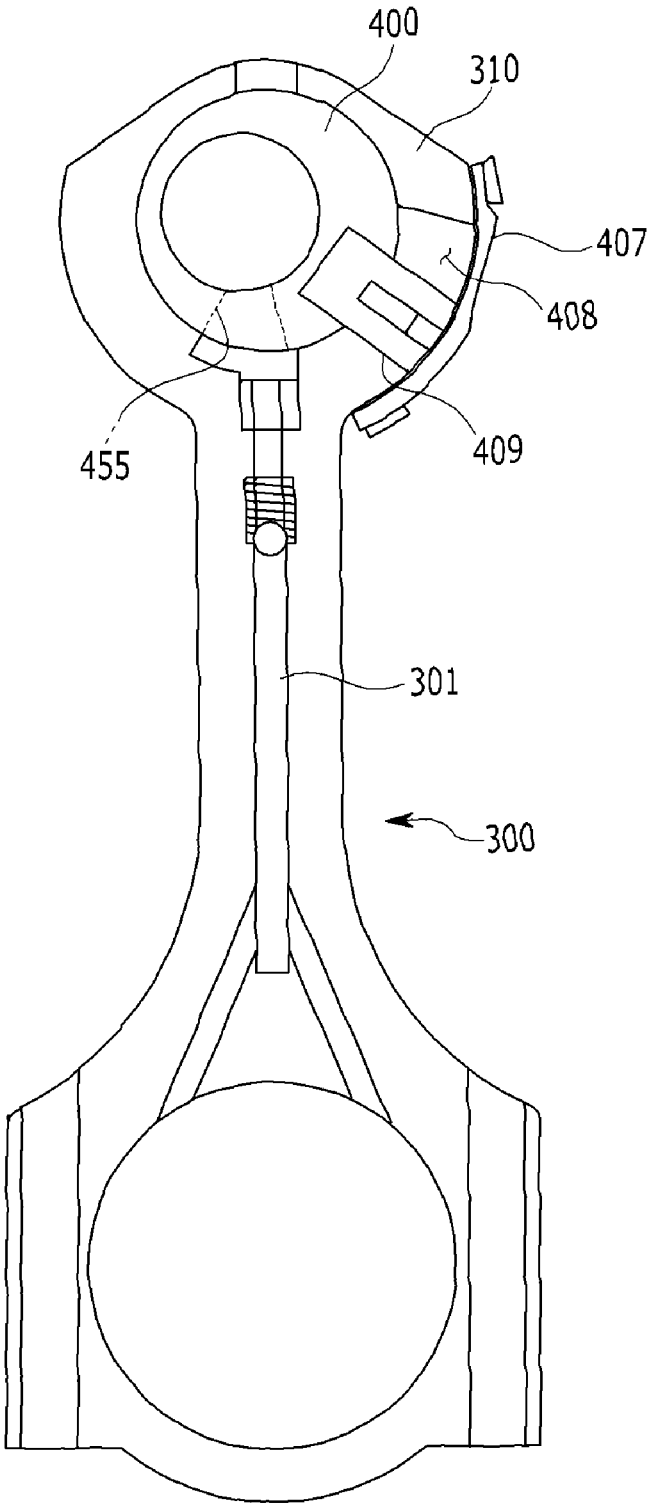
FIG. 8 is a cross-sectional view showing when an exemplary variable compression ratio device according to the present invention is applied to the small end of a connecting rode.

FIG. 8 is a cross-sectional view showing when a variable compression ratio device according to an exemplary embodiment of the present invention is applied to the small end of a connecting rod.

Figure 9:
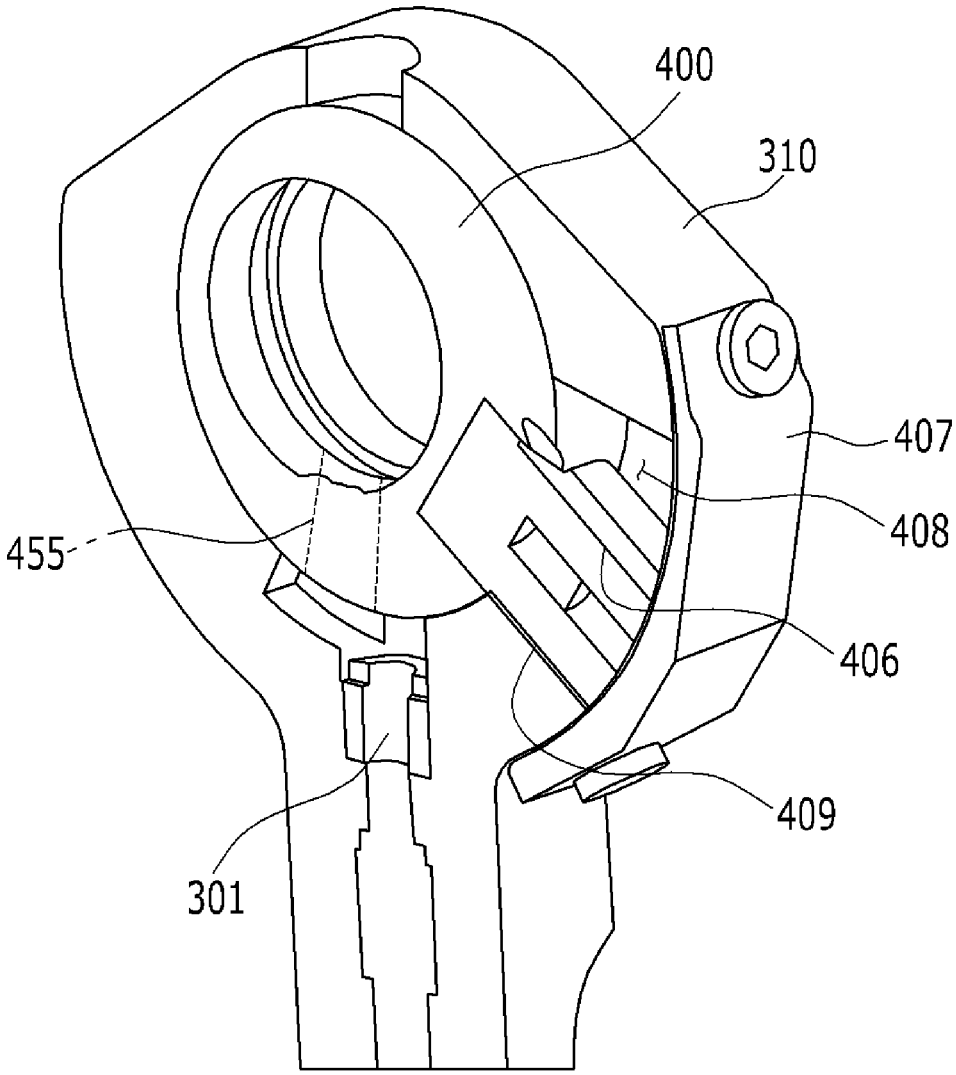
FIG. 9 is a perspective view showing the structure of FIG. 8.

FIG. 9 is a perspective view showing the structure of FIG. 8.

Figure 10:
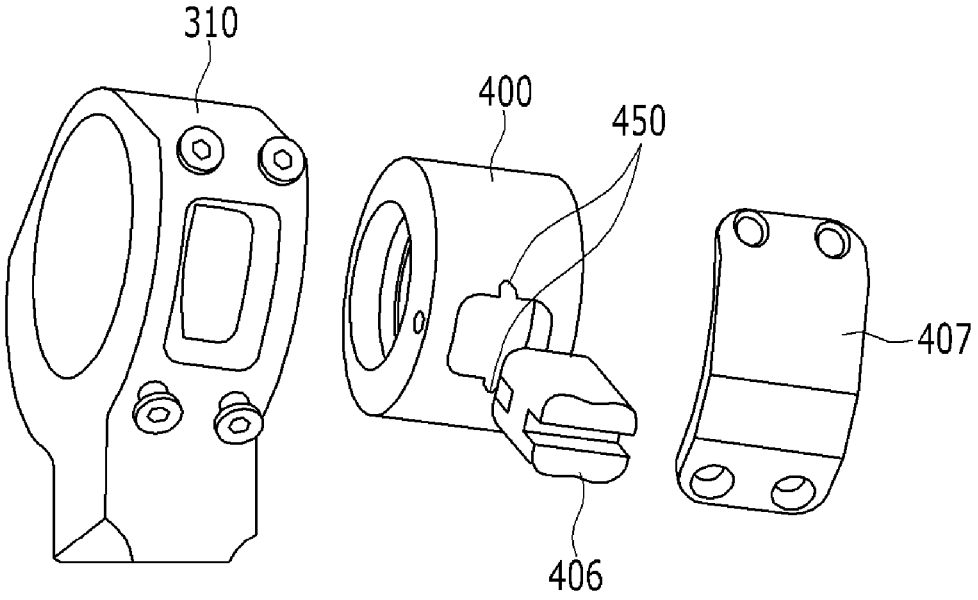
FIG. 10 is an exploded perspective view of FIG. 9.

FIG. 10 is an exploded perspective view of FIG. 9.

Figure 11:
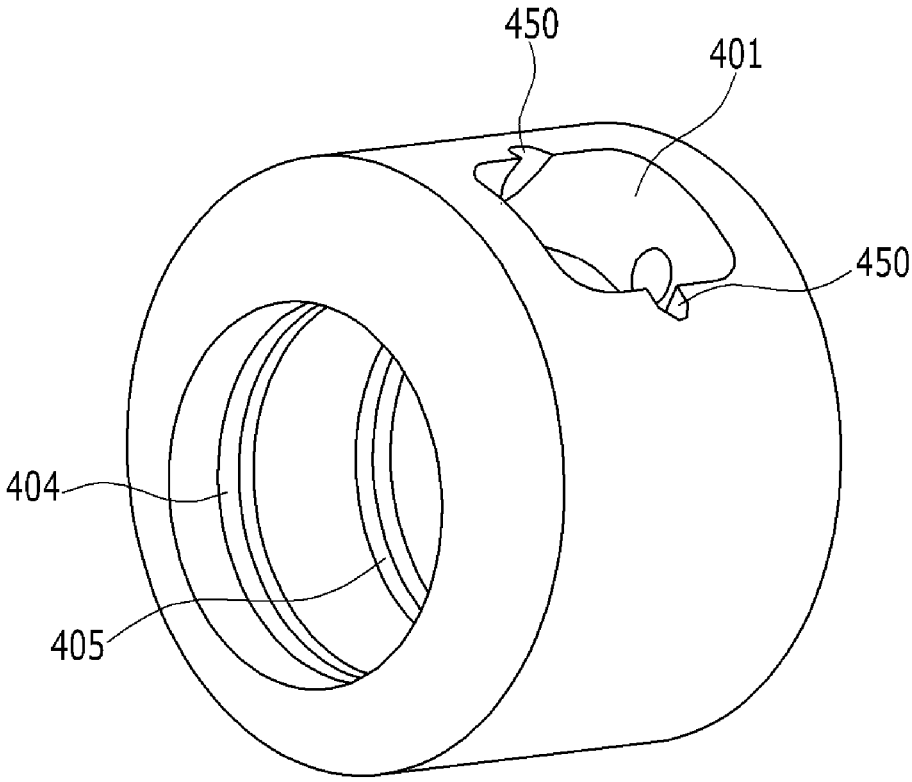
FIG. 11 is a perspective view schematically showing the inside of an eccentric ring that is applied to an exemplary variable compression ratio device according to the present invention.

FIG. 11 is a perspective view schematically showing the inside of an eccentric ring that is applied to a variable compression ratio device according to an exemplary embodiment of the present invention.

Figure 12:
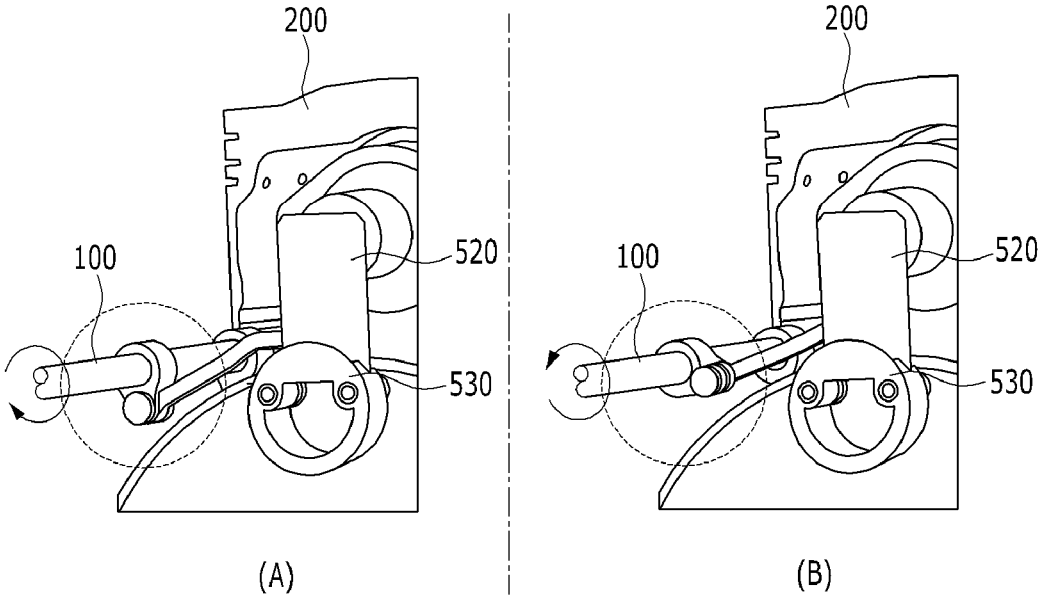
FIG. 12 is a view showing the operation of a variable shaft according to a compression ratio of an exemplary variable compression ratio device of the present invention.

FIG. 12 is a view showing the operation of a variable shaft according to a compression ratio of a variable compression ratio device of an exemplary embodiment of the present invention.

Figure 13:
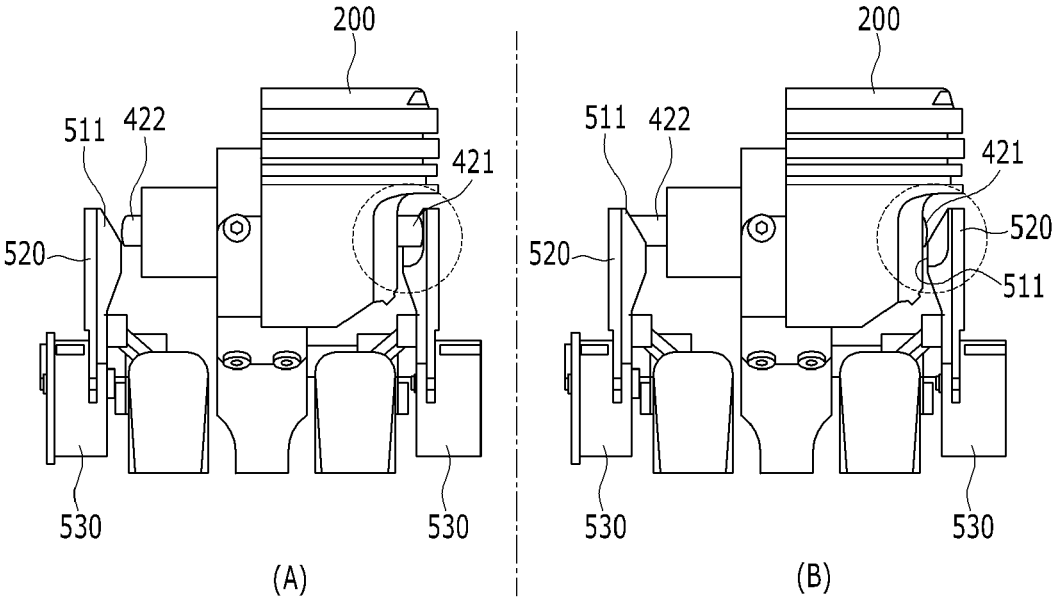
FIG. 13 is a view showing the operation of a variable slide according to a compression ratio of an exemplary variable compression ratio device of the present invention.

FIG. 13 is a view showing the operation of a variable slide according to a compression ratio of a variable compression ratio device of an exemplary embodiment of the present invention.

Figure 14:
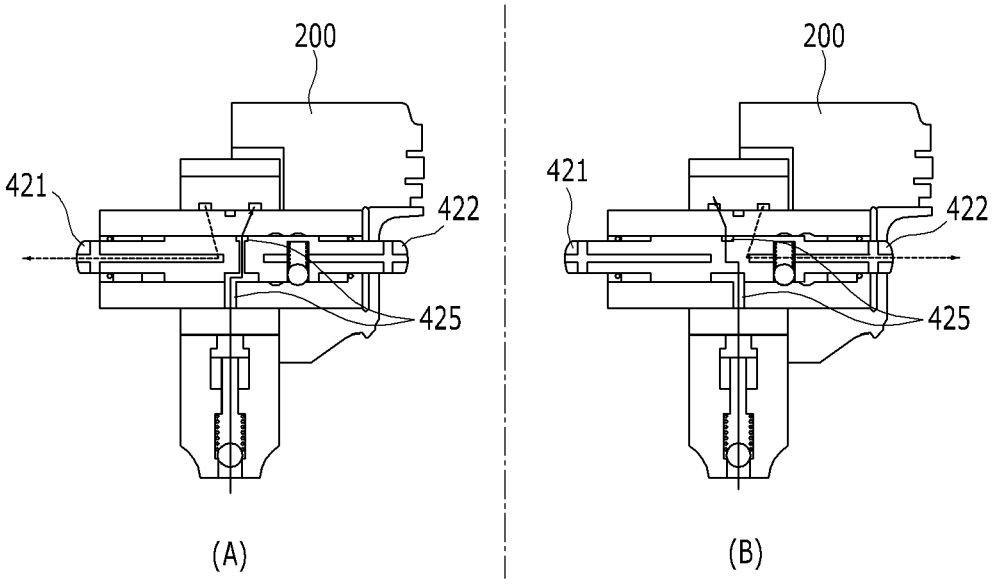
FIG. 14 is a view showing the inside of a connecting rod that operates in accordance with a compression ratio of an exemplary variable compression ratio device according to the present invention.

FIG. 14 is a view showing the inside of a connecting rod that operates in accordance with a compression ratio of a variable compression ratio device according to an exemplary embodiment of the present invention.

Figure 15:
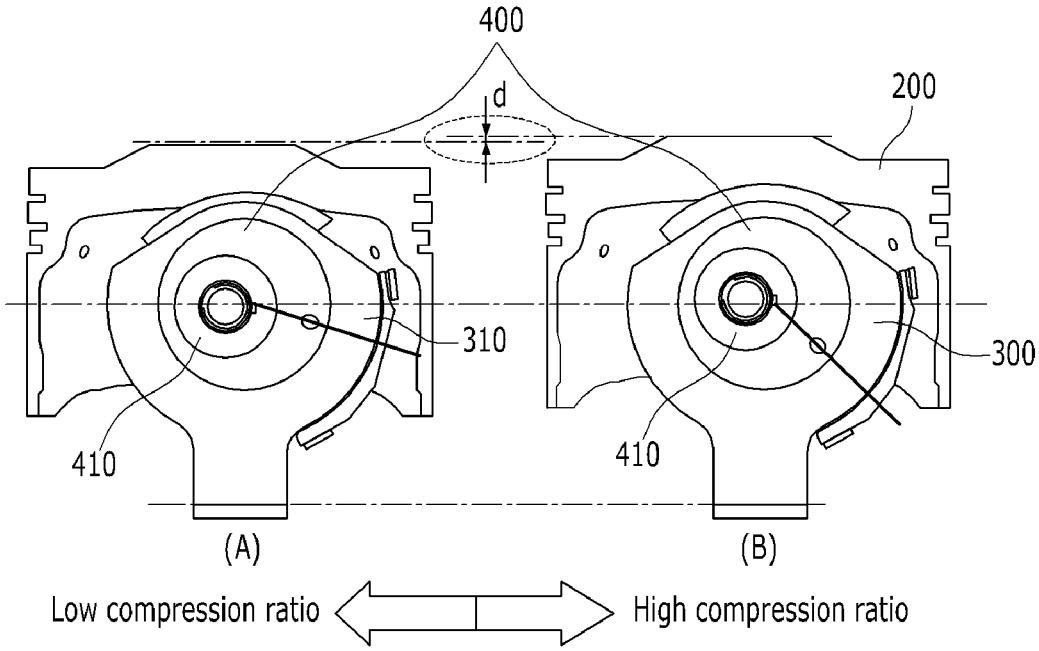
FIG. 15 is a view showing changes in height according to the compression ratio of a piston applied to an exemplary variable compression ratio device according to the present invention.

FIG. 15 is a view showing changes in height according to the compression ratio of a piston applied to a variable compression ratio device according to an exemplary embodiment of the present invention.

Referring to FIG. 1 and FIG. 2, a variable compression ratio device according to an exemplary embodiment of the present invention includes a variable shaft 100, a piston 200, a connecting rod 300 having a control channel 425 therein, an eccentric ring 400, a piston pin 410, an operating pin 420, operating arms 500, and variable sliders 510.

The variable shaft 100 is selectively rotated in one direction by an actuator 600 individually provided outside a cylinder block.

The actuator 600 may be any one as long as it can drive the variable shaft 100, such as a vacuum actuator.

In this configuration, the piston 200 mounted in the cylinder block reciprocates along the inner wall of the cylinder 150 such that a crankshaft 10 disposed thereunder rotates, and is connected to the upper end (hereafter, referred to as a small end) of the connecting rod 300.

Further, the eccentric ring 400 is disposed to rotate in contact with the inner circumference of a ring 320 in the small end 310.

Further, the piston pin 410 is inserted in the eccentric ring 400.

That is, the inner circumference of the eccentric ring 400 is in contact with outer circumference of the piston pin 410 and the outer circumference of the eccentric ring 400 is in contact with the inner circumference of the small end 310.

The eccentric ring 400 for changing the compression ratio of the engine is disposed coaxially with the piston pin 410 and the outer circumference of the eccentric ring 400 is biased from the center of the small end 310.

Further, as shown in FIG. 11, a mounting groove 401 is formed on the outer circumference of the eccentric ring 400.

Although, in the present exemplary embodiment, the shape of the mounting groove 401 is a quadrangle with rounded edges, any shape is possible as long as it can firmly retain the mounting protrusion 406, which is described later.

The mounting protrusion 406 protrudes outward from the mounting groove 401 at a predetermined height, when fitted in the mounting groove 401.

Further, oil holes 450 are formed on a bottom portion of the mounting groove 401 at both lateral sides of the mounting groove 401 in a circumferential direction thereof.

Oil circulation grooves 404 and 405 are formed in inner circumference of the eccentric ring 400 and the oil holes 450 are fluid-connected to the oil circulation grooves 404 and 405 respectively to selectively communicate with the oil supply channel 301 of the connecting rod 300, which is described below.

In the oil circulation grooves 404 and 405, oil is supplied through the oil circulation groove 404 and discharged through the other oil circulation groove 405, and vice versa.

Further, as shown in FIGS. 9 and 10, a cover 407 is provided to seal the outer side of the mounting protrusion 406.

That is, when the mounting protrusion 406 is fitted in the mounting groove 401 and the mounting protrusion 406 is firmly covered with the mounting cover 407, a space is defined between the outer circumference of the eccentric ring 400 and the mounting cover 407 and divided into both sides by the mounting protrusion 406 to function as oil chambers 408 and 409.

With this configuration, as oil is selectively supplied through the oil holes 450, hydraulic pressure is selectively applied in the oil chambers 408 and 409.

That is, the oil chambers 408 and 409 are separated to both sides by the mounting protrusion 406, such that as hydraulic pressure is selectively applied to the oil chambers 408 and 409 with the mounting protrusion 406 therebetween, the mounting protrusion 406 and the eccentric ring 400 make relative motion.

Further, as shown in FIGS. 5 to 7, an oil supply channel 301 is formed in the connecting rod 300 to supply oil to the oil chambers 408 and 409.

For this purpose, the eccentric ring 400 includes an oil inlet hole 455 formed between the oil circulation grooves 404 and 405 to the outer circumference thereof to receive the oil from the oil supply channel 301.

The piston pin 410 includes an oil input hole 470 and two oil supply holes 480, wherein the oil input hole 470 is fluid-connected with the oil inlet hole 455 of the eccentric ring 400 and the two oil supply holes 480 are fluid-connected to the oil circulation grooves 404 and 405 of the eccentric ring 400 respectively.

The operating pin 420 is mounted to reciprocate along the wall inside the piston pin 410.

For this structure, it is possible to more firmly combine the pins, by inserting the operating pin 420 into the piston pin 410, and then using a snap ring 412 and a stopper 411 fitted to both ends of the piston pin 410.

Further, an elastic member 423 and a ball 424 may be disposed in the outer surface of the operating pin 420 to improve operability of the operating pin 420. The ball 424 is elastically supported by the elastic member 423 and locked in a groove formed in the outer circumference of the piston pin 410 to correspond to the ball 424, such that it is possible to stably maintain a low compression ratio or a high compression ratio while the operating pin 420 slides.

In this configuration, the control channel 425 is formed in the operating pin 420. Furthermore, the operating pin 420 includes two oil discharge channels 490 and the control channel 425 is formed between the two oil discharge channels 490.

In this configuration, as the operating pin 420 reciprocate left and right, oil supplied to the oil input hole 470 of the piston pin 41 from the oil channel 301 is selectively supplied through one of the oil supply holes 480 to one of the oil chambers 408 and 409 separated by the mounting protrusion 406.

One of two oil discharge channels 490 of the operating pin 420 is selectively connected to one of the oil supply holes 480 of the operating pin 420 such that the other of the oil chambers 408 and 409 separated by the mounting protrusion 406 is discharged through the other of the oil supply holes 480 connected to the one of the two oil discharge channels 490 in accordance with the movement direction of the operating pin 420.

Meanwhile, as shown in FIG. 3, the variable shaft 100 is rotated about an axis by the actuator 600 individually provided. The actuator 600 may be a vacuum actuator, as described above.

In this configuration, at least two shaft rings 110 may be attached to the outer circumference of the variable shaft 100 to be fixed to the cylinder block. The shaft ring 110 may be fixed to the cylinder block by specific fasteners, such as a bolt.

Further, two operating arm 500 are attached to the outer circumference of the variable shaft 100.

First hinge portions 501 are formed at ends of the operating arms 500 to be combined with the first hinge portions 501 formed at the outer circumference of the variable shaft 100, while second hinge portions 502 are formed at the other ends and hinged to the variable sliders 510, which are described below.

The first and second hinge portions 501 and 502 connect the pair of operating arms 500 with the pair of variable sliders 510 such that they integrally rotate, when the variable shaft 100 rotates in one direction.

That is, the variable shaft 100 and the operating arms 500 are hinge-connected by the first hinge portions 501 and the operating arms 500 and the variable sliders 510 are hinge-connected by the second hinge portions 502 formed at the other ends of the operating arms 500.

That is, as the variable shaft 100 is rotated in one direction by the actuator 600, the operating arms 500 rotated by the first hinge portions 501 are reciprocated straight.

Therefore, the variable sliders 510 hinged-connected to the second hinge portions 502 of the operating arms 500 also reciprocate.

In this configuration, a guide plate 520 having a guide rail 525 for straight motion on the outer surface of the variable sliders 510 is provided.

That is, the guide rail 525 is a straight groove and a protrusion 512 fitted in the guide rail 525 is formed on one side of the variable slider 510.

Further, a protrusion 511 is formed on the opposite sides of the variable sliders 510.

The protrusions 511 are disposed to correspond to both ends 421 and 422 of the operating pin 420.

Further, the protrusions 511 are disposed not to correspond to each other in the front-rear direction.

That is, as shown in FIG. 4, when the variable sliders 510 are positioned in one vertical line to face each other, the protrusions 511 are not positioned in the vertical line, such that as the variable sliders 510 are selective moves forward and rearward, the protrusion 511 of any one of the variable sliders 510 selectively presses the ends 421 and 422 of the operating pin 420.

The guide plate 520 may be a plate that can guide the variable sliders 510 moving straight through the guide rail 525 and have an area which can ensure the movement distance.

Further, a fixing block 530 that fixes the variable slider 510 and the guide plate 520 is disposed under the guide plate 520.

The fixing block 530 is provided to firmly fix the guide plate 520 in the cylinder block, using connecting members.

The operation of a variable compression ratio device having the above configuration according to an exemplary embodiment of the present invention is described hereafter.

First, as shown in FIG. 12A, as the variable shaft 100 is rotated by the actuator 600 in switching to a low compression ratio, for example, in one direction (clockwise in the present embodiment), the operating arms 500 and the variable sliders 510 move to the variable shaft 100.

Thereafter, as shown in FIG. 13A, the protrusion 511 of any one of the variable sliders 510 presses one end 421 of the operating pin 420.

In this operation, the operating pin 420 slides to one side and the control channel 425 therein is opened, thereby controlling the path of the channel.

That is, as shown in FIG. 14A, the oil supplied through the oil supply channel 301 of the connecting rod 300 is supplied to the eccentric ring 400 selectively through the control channel 425 formed at one side in the operating pin 420.

Therefore, as shown in FIG. 15A, the mounting protrusion 406 fixed to the eccentric ring 400 is rotated by hydraulic pressure generated in the oil chamber 408 at one side, and the eccentric ring 400 is rotated in one direction by the above rotation.

Meanwhile, opposite to the switching into the low compression ratio, as shown in FIG. 12B, in switching into a high compression ratio, as the variable shaft 100 is rotated in the opposite direction by the actuator 600, the operating arms 500 and the variable sliders 510 move away from the variable shaft 100.

Thereafter, as shown in FIG. 13B, the protrusion 511 of the other variable slider 510 presses one end 422 of the operating pin 420.

In this operation, the operating pin 420 move to the other side and the other control channel 423 therein is opened, thereby controlling the path of the channel.

That is, as shown in FIG. 14B, the oil supplied through the oil supply channel 301 of the connecting rod 300 is supplied to the eccentric ring 400 selectively through the other control channel 425 formed in the operating pin 420.

Therefore, as shown in FIG. 15B, the mounting protrusion 406 fixed to the eccentric ring 400 is rotated by hydraulic pressure generated in the oil chamber 409 and the eccentric ring 400 is rotated in the opposite direction by the above operation.

As described above, since the rotational direction of the eccentric ring 400 is selectively changed by the sliding direction of the piston pin 420, a height difference 'd' shown in FIG. 15 is generated, thereby varying the height of the piston 200.

Accordingly, it is possible to adjust the compression ratio inside the cylinder.

For convenience in explanation and accurate definition in the appended claims, the terms "upper", "lower", "inner", and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A variable compression ratio device that includes a piston, a piston pin mounted to the piston, a crankshaft, and a connecting rod of which one end is connected to the piston by the piston pin and of which the other end is rotatably coupled to the crankshaft, the variable compression ratio device comprising:

an eccentric ring rotatably coupled in a ring at the one end of the connecting rod, wherein the inner circumference thereof rotatably contacts with the outer circumference of the piston pin and the center of the inner circumference thereof is biased from the center of the outer circumference thereof;

an operating pin that longitudinally reciprocates in the piston pin;

variable sliders that selectively contact one of both ends of the operating pin under a cylinder to push the one of both ends to the opposite side; and a guide plate that slidably supports the variable sliders such that the variable sliders vertically reciprocate with respect to the movement direction of the operating pin, wherein, one end of a variable shaft selectively rotating is connected to the variable slider and a sliding direction of the variable slider is controlled by the rotation of the variable shaft.

2. The variable compression ratio device of claim 1, wherein:

a mounting groove is formed on the outer circumference of the eccentric ring and oil holes are formed at both lateral ends of the mounting groove in a circumferential direction.

3. The variable compression ratio device of claim 2, wherein a mounting protrusion is couple to the mounting groove and forms oil chambers in the one end of the connecting rod in a forward and rearward direction of the mounting protrusion, and wherein the oil chambers are covered by a mounting cover to seal the mounting protrusion.

4. The variable compression ratio device of claim 2, wherein:

an oil supply channel is formed in the connecting rod to supply oil to the oil holes.

5. The variable compression ratio device of claim 4, wherein an oil inlet hole is formed in the eccentric ring to receive oil from the oil supply channel of the oil connecting rod.

6. The variable compression ratio device of claim 5, wherein the piston pin includes an oil input hole to fluid-communicate with the oil inlet hole of the eccentric ring to receive the oil from the oil supply channel of the connecting rod and includes oil supply holes.

7. The variable compression ratio device of claim 6, wherein a control channel is formed in the operating pin and fluid-communicates with the oil inlet hole of the piston pin and selectively fluid-communicates with the one of the oil supply holes of the piston pin to supply the oil to one of the oil chambers in accordance with longitudinal movement of the operating pin, and wherein the operating pin further includes oil discharge channels formed in a longitudinal direction at both end portions thereof, and wherein the oil disposed in the other of the chambers are discharged through the oil supply hole not engaged with the control channel by fluid-connecting one of the oil discharge channel in the operating pin.

8. The variable compression ratio device of claim 7, wherein the ring of the connecting rod includes circulation grooves formed along the inner circumference of the ring and wherein the circulation grooves are connected to the oil holes of the eccentric ring.

9. The variable compression ratio device of claim 1, wherein:

a protrusion is formed on the inner surface of the variable sliders to correspond to both ends of the operating pin, and disposed not to correspond to each other in the same moving direction.

10. The variable compression ratio device of claim 1, wherein:

the variable shaft and the variable sliders are connected by operating arms.

11. The variable compression ratio device of claim 10, wherein:

shaft rings are formed on the outer circumference of the variable shaft to integrally rotate, the variable shaft and the operating arms are connected by first hinge portions formed at the shaft rings, the operating arms are connected with the variable sliders by second hinge portions, and as the variable shaft selectively rotates in one direction, the operating arms allow the variable sliders to reciprocate straight through the first hinge portions and the second hinge portions.

12. The variable compression ratio device of claim 1, wherein:

a guide rail is formed on one side of the guide plate to guide the variable sliders to reciprocate forward and rearward and a fixing block is formed under the guide rail to fix the guide plate.

13. The variable compression ratio device of claim 1, wherein:

the variable shaft is driven by a vacuum actuator individually provided.

* * * * *